US006854458B2

(12) United States Patent
Herzer

(10) Patent No.: US 6,854,458 B2
(45) Date of Patent: Feb. 15, 2005

(54) OVEN WITH DOOR

(75) Inventor: Karl Herzer, Bretten (DE)

(73) Assignee: BSH Bosch und Siemens Hausgerate GmbH, Munich (DE)

( * ) Notice: Subject to any disclaimer, the term of this patent is extended or adjusted under 35 U.S.C. 154(b) by 0 days.

(21) Appl. No.: 10/635,584

(22) Filed: Aug. 6, 2003

(65) Prior Publication Data

US 2004/0089287 A1 May 13, 2004

Related U.S. Application Data

(63) Continuation of application No. PCT/EP02/01123, filed on Feb. 4, 2002.

(30) Foreign Application Priority Data

Feb. 6, 2001 (DE) ..... 101 05 543

(51) Int. Cl.[7] ..... F24C 15/04
(52) U.S. Cl. ..... 126/198; 126/200
(58) Field of Search ..... 126/190, 198, 126/200; 49/DIG. 1

(56) References Cited

U.S. PATENT DOCUMENTS 3,189,020 A * 6/1965 Getman ..... 126/190
3,250,268 A * 5/1966 More et al. ..... 126/200
3,396,717 A * 8/1968 Winkler et al. ..... 126/200
3,507,267 A * 4/1970 Lafforgue ..... 126/200
3,612,825 A * 10/1971 Chase et al. ..... 126/200
4,716,884 A * 1/1988 Bonaccorsi et al. ..... 126/200
6,558,596 B1 * 5/2003 Bienick et al. ..... 264/154

FOREIGN PATENT DOCUMENTS

| | | |
|---|---|---|
| CH | 633 413 | 12/1982 |
| DE | 37 12 232 C2 | 10/1988 |
| DE | 195 23 772 A1 | 1/1997 |
| EP | 0 754 919 A1 | 1/1997 |
| EP | 1 211 465 A2 | 6/2002 |
| FR | 2563612 A3 * | 10/1985 |

* cited by examiner

*Primary Examiner*—Sara Clarke
(74) *Attorney, Agent, or Firm*—Laurence A. Greenberg; Werner H. Stemer; Gregory L. Mayback

(57) ABSTRACT

A cooking appliance includes a cooking chamber that can be closed by a door having a multi-pane structure, including at least one inner pane and one front pane. The invention configures the cooking appliance such that the surface temperature on the outer side of the front pane is as low as possible. To this end, the inner pane is embodied in a tray-like manner and is fixed to the front pane by holding elements that are disposed on the inner side of the front pane inside the circumferential edge of the inner pane.

15 Claims, 2 Drawing Sheets

OVEN WITH DOOR

CROSS-REFERENCE TO RELATED APPLICATION

This application is a continuation of copending International Application No. PCT/EP02/01123, filed Feb. 4, 2002, which designated the United States and was not published in English.

BACKGROUND OF THE INVENTION

Field of the Invention

The invention relates to an oven or cooker with a cooking chamber that can be closed with a door.

In particular, oven doors that have a glass viewing panel disposed in an enameled sheet-steel frame, which is covered on the front side by a glass panel, are known in practice. On account of the high thermal conductivity of the sheet steel, the front panels of these ovens can heat up to such a pronounced extent during cooking, or, in particular, during pyrolytic operation, that the user may get burnt here.

Furthermore, German Patent DE 37 12 232 C2 discloses a household-appliance front that includes a split, frameless, two-part front-panel body. Located between the front glass panel for a switch plane and the front panel for an oven door is a separate oven, door-handle and ventilation-grille configuration, which runs flush with the front plane of the front-panel body. The construction of this multi-part front panel is, in practice, very labor-intensive and expensive. Because, furthermore, an inner panel, which usually is of sheet steel, is disposed on the inside of the front panel, it is also possible with this construction of the door cover, on account of the thermal conduction, for a very high surface temperature to be established on the outside of the front glass panel.

Similar conditions prevail in the case of the household-appliance door that is known from German Published, Non-Prosecuted Patent Application DE 195 23 772 A1 because it is also the case with this known configuration that the glass covering panel is connected to a pan-like metallic inner panel.

SUMMARY OF THE INVENTION

It is accordingly an object of the invention to provide an oven with a door that overcomes the hereinafore-mentioned disadvantages of the heretofore-known devices of this general type and that allows the surface temperature on the outside of the front panel to be as low as possible.

With the foregoing and other objects in view, there is provided, in accordance with the invention, an oven, including a cooking chamber with a door opening, a door movably associated with the cooking chamber for closing the door opening, the door being multi-paneled and having a front panel having an inside and a peripheral border, retaining elements disposed on the inside of the front panel within the peripheral border of the inner panel, and at least one pan-shaped inner panel fastened on the front panel by the retaining elements.

Designing the door according to the invention from glass gives rise to a considerable reduction in the surface temperature on the front panel, on account of the glass having lower levels of thermal conduction than metal. Furthermore, the glass configuration makes it possible, if appropriate, to reduce the number of components that are necessary for constructing the door, this, in turn, resulting in a reduction of costs. It is also the case that a door configured according to the invention is easy to clean and, on account of the predominant use of a single material, readily recyclable.

In accordance with another feature of the invention, the inner panel can be fixed to the front panel through retaining elements disposed on the inside of the front panel. Examples of retaining elements that may be used are angled elements, in particular, made of metal, which can be adhesively bonded to the front panel. To improve the connection, the inner panel may be screwed to the retaining elements. For installation and removal of the inner panel, for example, for the purpose of cleaning the door, all that is, then, necessary is for the screw connections to be tightened or released respectively.

In accordance with a further feature of the invention, the inner panel has a periphery with a raised border section having an end surface and terminates, around the periphery, in the raised border section, the end surface butting against the inside of the front panel.

In accordance with an added feature of the invention, the inner panel has a periphery terminating with a raised border section having an end surface butting against the inside of the front panel.

In accordance with an additional feature of the invention, to achieve additional insulation and sealing between the inner panel and the front panel, the inner panel is sealed against the inside of the front panel through a peripheral seal.

In accordance with yet another feature of the invention, the inner panel is formed with air-inlet and air-outlet openings for ventilation of the door. Furthermore, the air-inlet and air-outlet openings are formed, for example, between the inner panel and the inside of the front panel, in order to avoid a build-up of heat in the interior of the pan-like inner panel.

In accordance with yet a further feature of the invention, the front panel is formed of a material and has an integral door handle formed from the material. Preferably, a handle attachment is secured on the door handle.

The practice of reducing the materials for constructing the door substantially to a single material—glass—can be extended further according to the invention in that the handle for opening and closing the door is integrally formed on the front side of the front panel from the same material as the front panel. To protect the glass edge or else also to provide for further heat insulation, a handle attachment, for example, made of plastic, can be fixed to the door handle.

In accordance with yet an added feature of the invention, the invention proposes that the door can be fixed to the oven housing of the oven through door fittings that can be adhesively bonded or screwed to the front panel.

In accordance with yet an additional feature of the invention, the inner panel is of a material and the material is borosilicate glass.

With the objects of the invention in view, there is also provided an oven, including a cooking chamber with a door opening and a door movably associated with the cooking chamber for closing the door opening, the door having a front panel having an inside surface and a peripheral border, retaining elements disposed at the inside surface within the peripheral border, and at least one pan-shaped inner panel fastened to the front panel by the retaining elements.

With the objects of the invention in view, there is also provided an oven door for closing a cooking chamber of an oven, including a front panel having an inside and a peripheral border, retaining elements disposed on the inside of the front panel within the peripheral border of the inner panel, and at least one pan-shaped inner panel fastened on the front panel by the retaining elements.

Other features that are considered as characteristic for the invention are set forth in the appended claims.

Although the invention is illustrated and described herein as embodied in an oven with a door, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
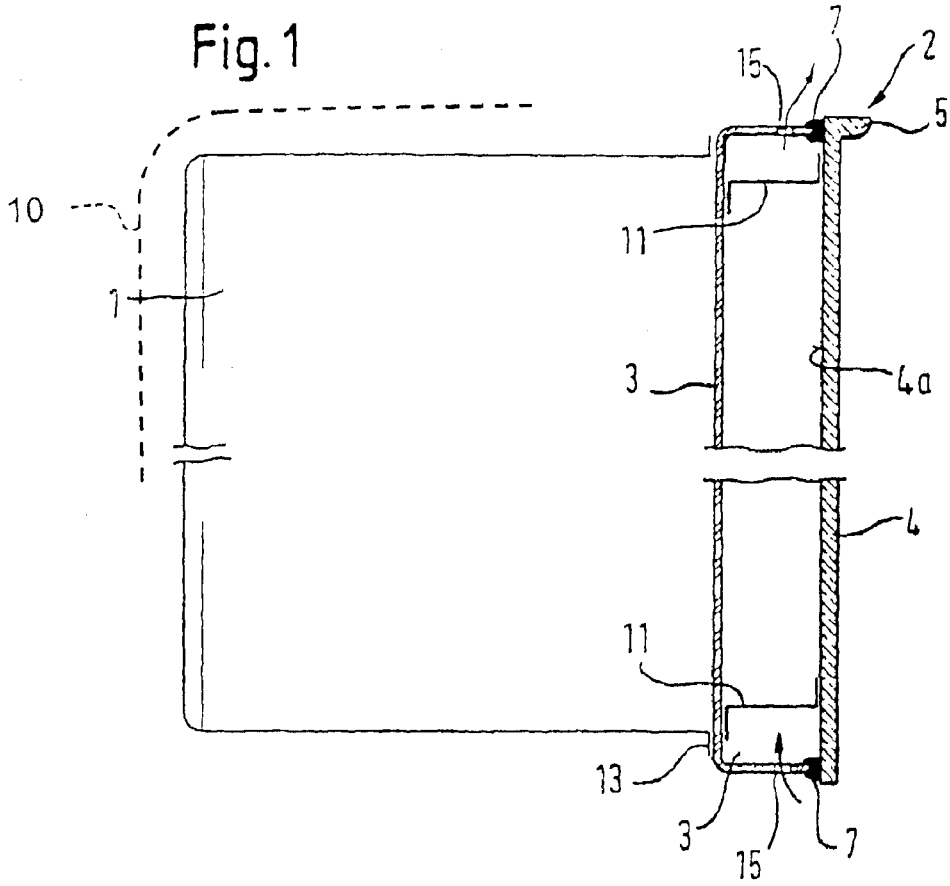
FIG. 1 is a fragmentary, cross-sectional view from the side of a cooking chamber with a door without an oven housing according to a first exemplary embodiment of the invention.

Referring now to the figures of the drawings in detail and first, particularly to FIG. 1 thereof, there is shown, with an oven housing 10, a portion of which is indicated by dashed lines, with non-illustrated heating elements or further known components, and a muffle that is known per se and forms a cooking chamber 1, which can be closed off from the surroundings through a door 2. The multi-panel door 2 substantially includes a pan-like inner panel 3 and a front panel 4, which can be fixed to the inner panel 3.

The door 2 for closing the cooking chamber 1 is of shaped glass, that is to say, both the inner panel 3 and the front panel 4 are of shaped glass. By virtue of the entire door 2 being configured from glass, the thermal conduction from the interior of the cooking chamber 1 to the front panel 4 is considerably reduced in relation to the conventional oven doors that have at least one door base made of metal, in particular, sheet steel, securing the inner panel. In the case of the oven illustrated, there is, thus, barely any risk of the user burning himself/herself on the hot front panel 4. In order for it to be possible to ventilate the door, suitable air-admission and air-extraction openings 15 are provided in the inner panel 3.

Figure 2:
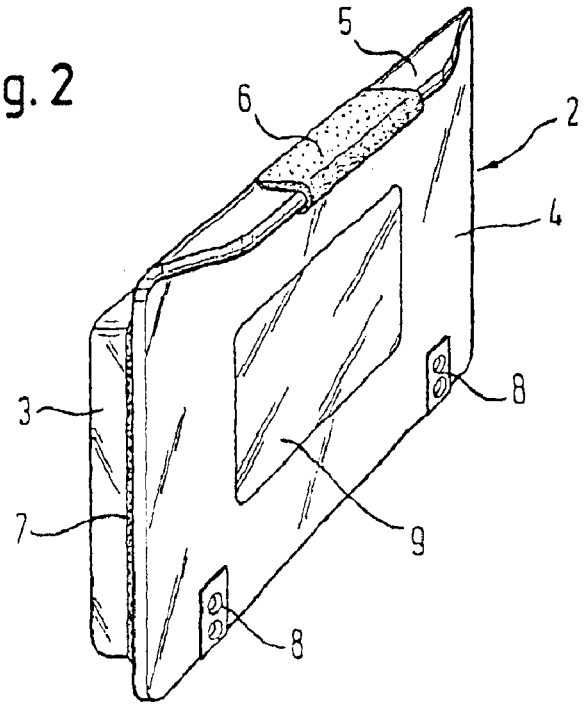
FIG. 2 is a perspective view of the door of FIG. 1.

As can be seen from FIG. 2 in particular, a door handle 5 is formed directly from the glass material of the front panel 4. The handle 5 is produced by configuring the front panel 4 to be bent forward in its top end section. The number of individual components for constructing such a door 2 can be further reduced in this way. Furthermore, the use of predominantly just one material is advantageous from an ecological standpoint because the appliance can, later, be recycled easily and as a single material. In the case of the embodiment according to FIG. 2, a handle attachment 6 is attached to the door handle 5. This handle attachment 6, which is produced, for example, from plastic, may be pushed onto the door handle 5, and/or adhesively bonded thereto, for visual reasons or for thermal-insulation purposes.

For the purpose of sealing the inner panel 3, and of securing the inner panel 3 in an impact-resistant manner, in relation to the inside 4*a* of the front panel 4, the inner panel 3 has a peripheral seal 7, by way of which the inner panel 3 butts against the inside 4*a* of the front panel 4. For such a purpose, the profiled seal 7 is plugged on the end section of the raised pan border of the inner panel 3. Air-inlet and air-outlet openings 15 may, additionally, be formed between the inner panel 3 and the front panel 4, in order to avoid a build-up of heat in the interior of the pan-like inner panel 3. The inner panel 3 is fastened on the inside 4*a* of the front panel through a plurality of angled retaining elements 11. The retaining element 11, here, is connected, for example, both to the inner panel 3 and to the front panel 4 by adhesion. If required, it is possible for the inner panel 3 to be fixed to the retaining elements 11, alternatively or in addition, by screws.

The door 2 is fixed to the oven housing through door fittings 8 that can be adhesively bonded or screwed to the front panel 4. Hinges (not shown specifically) are, then, fastened on the door fittings, and are additionally secured on the oven housing. Alternatively, it is also possible for the door to be configured as a sliding oven door and to be guided in a displaceable manner on the oven, as is known, through runners. As can further be seen from FIG. 2, it is possible for the front panel 4 and the inner panel 3 to be provided with printing or lamination such that only a partial viewing window 9 remains in the front panel 4 and, correspondingly, in the inner panel 3, this window giving a view into the cooking chamber 1.

Figure 3:
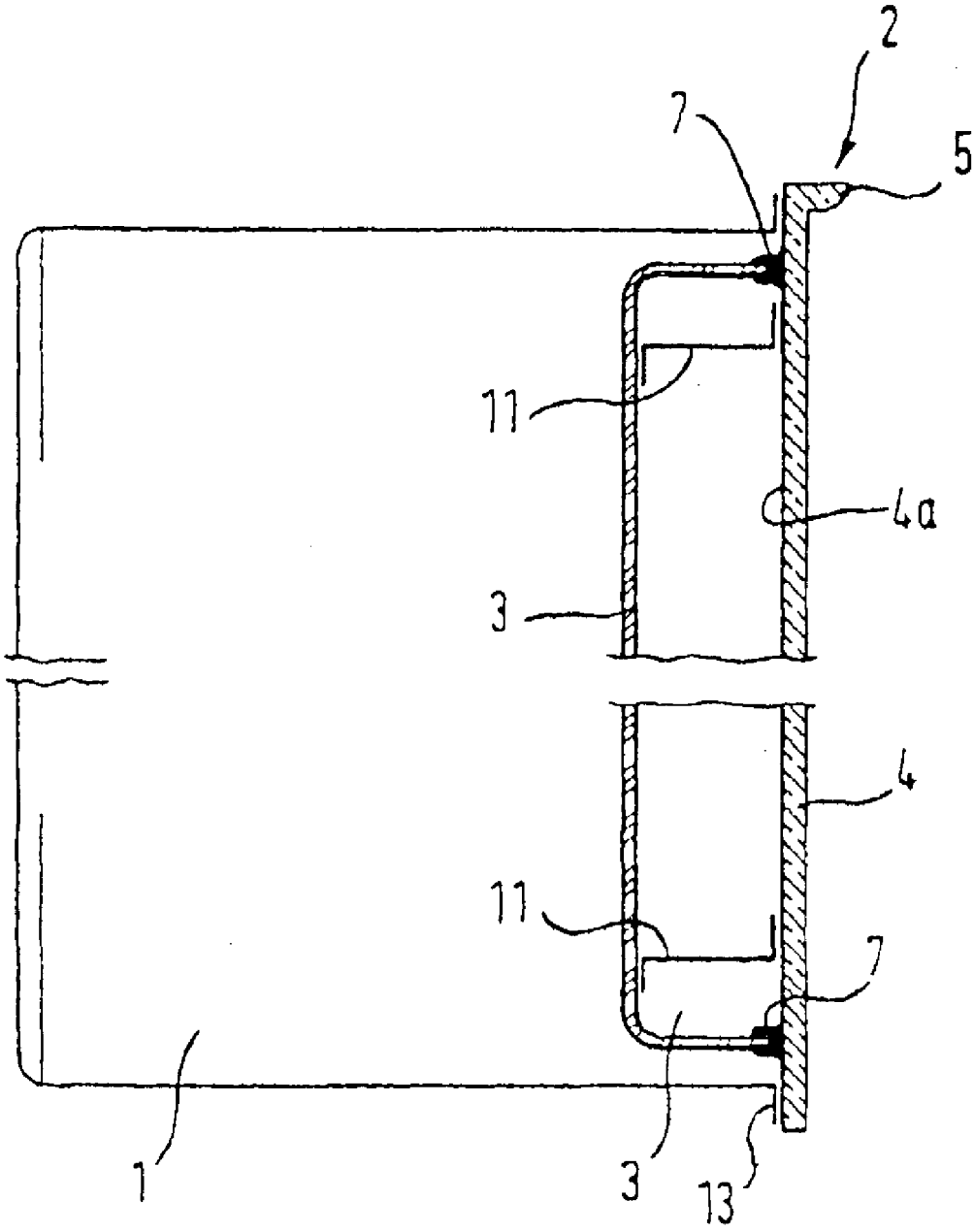
FIG. 3 is a fragmentary, cross-sectional view from the side of a cooking chamber with a door without an oven housing according to a second exemplary embodiment of the invention.

In the second exemplary embodiment according to FIG. 3, the pan-like inner panel 3 penetrates into the cooking chamber 1. In such a case, the inside 4*a* of the front panel 4 rests against a flange 13 of the muffle of the cooking chamber 1, which is contrasted with the embodiment of FIG. 1 in which the rear of the inner panel 3 rests against the flange 13 of the muffle of the cooking chamber 1.

I claim:

1. An oven, comprising:

a cooking chamber with a door opening; and a door movably associated with said cooking chamber for closing said door opening, said door being multi-paneled and having:

a front panel having an inside;

at least one pan-shaped inner panel consisting essentially of non-metallic material and having a peripheral border; and retaining elements disposed on said inside of said front panel within said peripheral border of said inner panel, said retaining elements fastening said inner panel to said inside of said front panel.

2. The oven according to claim 1, wherein said inner panel has a periphery with a raised border section having an end surface and terminates, around said periphery, in said raised border section, said end surface butting against said inside of said front panel.

3. The oven according to claim 1, wherein said inner panel has a periphery terminating with a raised border section having an end surface butting against said inside of said front panel.

4. The oven according to claim 1, further comprising a peripheral seal sealing said inner panel against said inside of said front panel.

5. The oven according to claim 1, wherein said inner panel is formed with air-inlet and air-outlet openings for ventilation of said door.

6. The oven according to claim 1, wherein said inner panel is formed with air-inlet and air-outlet openings between said inner panel and said front panel for ventilation of said door.

7. The oven according to claim 1, wherein said front panel is formed of a material and has an integral door handle formed from said material.

8. The oven according to claim 7, further comprising a handle attachment secured on said door handle.

9. The oven according to claim 1, wherein said door has door fittings secured on the front panel for fixing said door to an oven housing.

10. The oven according to claim 1, further comprising an oven housing, said door having door fittings secured on the front panel fixing said door to said oven housing.

11. The oven according to claim 1, wherein:

said inner panel is of a material; and said material is borosilicate glass.

12. The oven according to claim 1, wherein said non-metallic material is glass.

13. The oven according to claim 1, wherein said front panel is formed of glass.

14. An oven, comprising:

a cooking chamber with a door opening; and a door movably associated with said cooking chamber for closing said door opening, said door having:

a front panel having an inside surface;

at least one pan-shaped inner panel consisting essentially of non-metallic material and having a peripheral border; and retaining elements disposed at said inside surface of said front panel within said peripheral border of said inner panel, said retaining elements fastening said inner panel to said front panel.

15. A oven door for closing a cooking chamber of an oven, comprising:

a front panel having an inside;

at least one pan-shaped inner panel consisting essentially of non-metallic material and having a peripheral border; and retaining elements disposed on said inside of said front panel within said peripheral border of said inner panel, said retaining elements fastening paid inner panel to said inside of said front panel.

* * * * *